US009607562B2

(12) United States Patent
Kim et al.

(10) Patent No.: US 9,607,562 B2
(45) Date of Patent: Mar. 28, 2017

(54) METHOD OF DRIVING DISPLAY PANEL AND DISPLAY APPARATUS FOR PERFORMING THE SAME

(71) Applicant: Samsung Display Co., LTD., Yongin, Gyeonggi-Do (KR)

(72) Inventors: Gi-Geun Kim, Seoul (KR); Jung-Won Kim, Seoul (KR); Ja-Kyoung Jin, Daegu (KR); Nam-Gon Choi, Yongin-si (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 0 days.

(21) Appl. No.: 14/594,942

(22) Filed: Jan. 12, 2015

(65) Prior Publication Data

US 2016/0035260 A1 Feb. 4, 2016

(30) Foreign Application Priority Data

Jul. 30, 2014 (KR) ..... 10-2014-0097236

(51) Int. Cl.
*G09G 3/36* (2006.01)

(52) U.S. Cl.
CPC ... *G09G 3/3614* (2013.01); *G09G 2320/0252* (2013.01); *G09G 2330/021* (2013.01); *G09G 2340/0435* (2013.01)

(58) Field of Classification Search
CPC ..... G09G 3/3648; G09G 3/36; G09G 3/3614; G09G 2320/0223; G09G 2320/0247; G09G 2320/0257; G09G 2330/021; G09G 2340/0435; G09G 2320/103; G09G 2320/0252; G09G 5/10; G09G 3/20; G09G 3/10
See application file for complete search history.

(56) References Cited

U.S. PATENT DOCUMENTS

2002/0126083 A1* 9/2002 Cairns ..... G09G 3/20 345/98
2007/0146237 A1* 6/2007 Lee ..... G09G 5/003 345/42
2008/0158454 A1* 7/2008 Shin ..... G09G 3/3607 349/36
2010/0253611 A1* 10/2010 Takagi ..... G09G 3/3611 345/98

(Continued)

FOREIGN PATENT DOCUMENTS

KR 100237211 B1 10/1999
KR 1020080096379 A 10/2008
KR 1020130075112 A 7/2013

*Primary Examiner* — Lun-Yi Lao
*Assistant Examiner* — Jarurat Suteerawongsa
(74) *Attorney, Agent, or Firm* — Robert E. Bushnell, Esq.

(57) ABSTRACT

A method of driving a display panel is proposed. The method includes determining whether an input image data represents a video image or a static image, determining whether an image transition occurs in the input image data when the input image data represents the static image, and inserting a plurality of image sticking compensation frames between normal frames in a low frequency driving when the image transition occurs in the input image data between the normal frames. The number of the image sticking compensation frame may be properly adjusted during a cycle of low frequency driving.

15 Claims, 8 Drawing Sheets

(56) References Cited

U.S. PATENT DOCUMENTS

2010/0265280 A1* 10/2010 Yen ..... G09G 3/3406
345/691
2015/0145900 A1 5/2015 Lee et al.

* cited by examiner

METHOD OF DRIVING DISPLAY PANEL AND DISPLAY APPARATUS FOR PERFORMING THE SAME

PRIORITY STATEMENT

This application claims priority under 35 U.S.C. §119 to Korean Patent Application No. 10-2014-0097236, filed on Jul. 30, 2014 in the Korean Intellectual Property Office KIPO, the contents of which are herein incorporated by reference in their entireties.

BACKGROUND

Field of the Invention

Exemplary embodiments of the present invention relate to a method of driving a display panel and a display apparatus for performing the method. More particularly, exemplary embodiments of the present invention relate to a method of driving a display panel for reducing a power consumption and improving a display quality, and a display apparatus for performing the method.

Description of the Related Art

A method to minimize a power consumption of an information technology (IT) product such as a table personal computer (PC) and a note PC have been studied.

To minimize the power consumption of the IT product which includes a display panel, a power consumption of the display panel may be minimized. When the display panel displays a static image, the display panel may be driven in a relatively low frequency so that a power consumption of the display panel may be reduced.

In the case of the liquid crystal display panel, if the display panel is driven in the relatively low frequency, a charging time in the display panel may not be sufficient due to a slow response time of liquid crystals in an image transition moment. Thus, an image sticking may be instantaneously generated.

SUMMARY

Exemplary embodiments of the present invention provide a method of driving a display panel capable of reducing a power consumption and improving a display quality. Exemplary embodiments of the present invention also provide a display apparatus for performing the above-mentioned method.

In an exemplary embodiment of a method of driving a display panel according to the present invention, the method includes determining whether an input image data represents a video image or a static image, determining whether an image transition occurs in the input image data when the input image data represents a static image, and inserting a plurality of image sticking compensation frames between normal frames in a low frequency driving when the image transition occurs in the input image data between the normal frames.

In an exemplary embodiment, a polarity of the display panel may be inverted in every frame. The number of the image sticking compensation frames inserted during a cycle of low frequency driving may be an odd number equal to or greater than three.

In an exemplary embodiment, a polarity of the display panel may be inverted in every two frames. The number of the image sticking compensation frames inserted during a cycle of low frequency driving may be 4N−2. N is a positive integer.

In an exemplary embodiment, a data signal of the image sticking compensation frame for a first image may be substantially the same as a data signal of the normal frame for the first frame.

In an exemplary embodiment, at least one image sticking compensation frame after the image transition may be overshot using a data signal greater than a target data signal.

In an exemplary embodiment, a data signal of an image sticking compensation frame which is not overshot may be substantially the same as the target data signal.

In an exemplary embodiment, when the input image data represents the static image and has a relatively high flicker generating degree, the display panel may be driven at a first low frequency less than a normal driving frequency. When the input image data represents the static image and has a relatively low flicker generating degree, the display panel may be driven at a second low frequency less than the first low frequency. When the input image data represents a text static image including a text, the display panel may be driven at a third low frequency less than the second low frequency.

In an exemplary embodiment of a display apparatus according to the present invention, the display apparatus includes a display panel, a timing controller and a data driver. The display panel is configured to display an image. The timing controller is configured perform operations to determine whether an input image data represents a video image or a static image, to determine whether an image transition occurs in the input image data when the input image data represents the static image, and to insert a plurality of image sticking compensation frames between normal frames in a low frequency driving to generate a data signal when the image transition occurs in the input image data between the normal frames. The data driver is configured to generate a data voltage based on the data signal and output the data voltage to the display panel.

In an exemplary embodiment, the timing controller may include a low frequency driving unit configured to generate a first data signal having a relatively high frequency when the input image data represents the video image and a second data signal having a relatively low frequency when the input image data represents the static image and a compensation frame generating unit configured to insert the image sticking compensation frames between the normal frames during the cycle of low frequency driving to generate a third data signal when the input image data represents the static image and the image transition occurs in the input image data.

In an exemplary embodiment, a polarity of the display panel may be inverted in every frame. The number of the image sticking compensation frames inserted in the low frequency driving may be an odd number equal to or greater than three.

In an exemplary embodiment, a polarity of the display panel may be inverted in every two frames. The number of the image sticking compensation frames inserted in the low frequency driving may be 4N−2. N is a positive integer.

In an exemplary embodiment, a data signal of the image sticking compensation frame for a first image may be substantially the same as a data signal of the normal frame for the first frame.

In an exemplary embodiment, the compensation frame generating unit may overshoot at least one image sticking compensation frame after the image transition using a data signal greater than a target data signal.

In an exemplary embodiment, a data signal of an image sticking compensation frame which is not overshot may be substantially the same as the target data signal.

In an exemplary embodiment, when the input image data represents a static image and has a relatively high flicker generating degree, the low frequency driving unit may be configured to generate the second data signal having a first low frequency less than a normal driving frequency. When the input image data represents a static image and has a relatively low flicker generating degree, the low frequency driving unit may be configured to generate the second data signal having a second low frequency less than the first low frequency. When the input image data represents a text static image including a text, the low frequency driving unit may be configured to generate the second data signal having a third low frequency less than the second low frequency.

According to the method of driving the display panel and the display apparatus for performing the display panel, a driving frequency is adjusted according to an image displayed on the display panel so that a power consumption of the display apparatus may be reduced. In addition, when an image of the input data signal is transitioned in a low frequency driving, a compensation frame is generated so that an image sticking due to lack of a charging rate may be prevented.

BRIEF DESCRIPTION OF THE DRAWINGS

The above and other features and advantages of the present invention will become more apparent by describing in detailed exemplary embodiments thereof with reference to the accompanying drawings, in which.

DETAILED DESCRIPTION OF THE INVENTION

Hereinafter, the present invention will be explained in detail with reference to the accompanying drawings.

Figure 1:
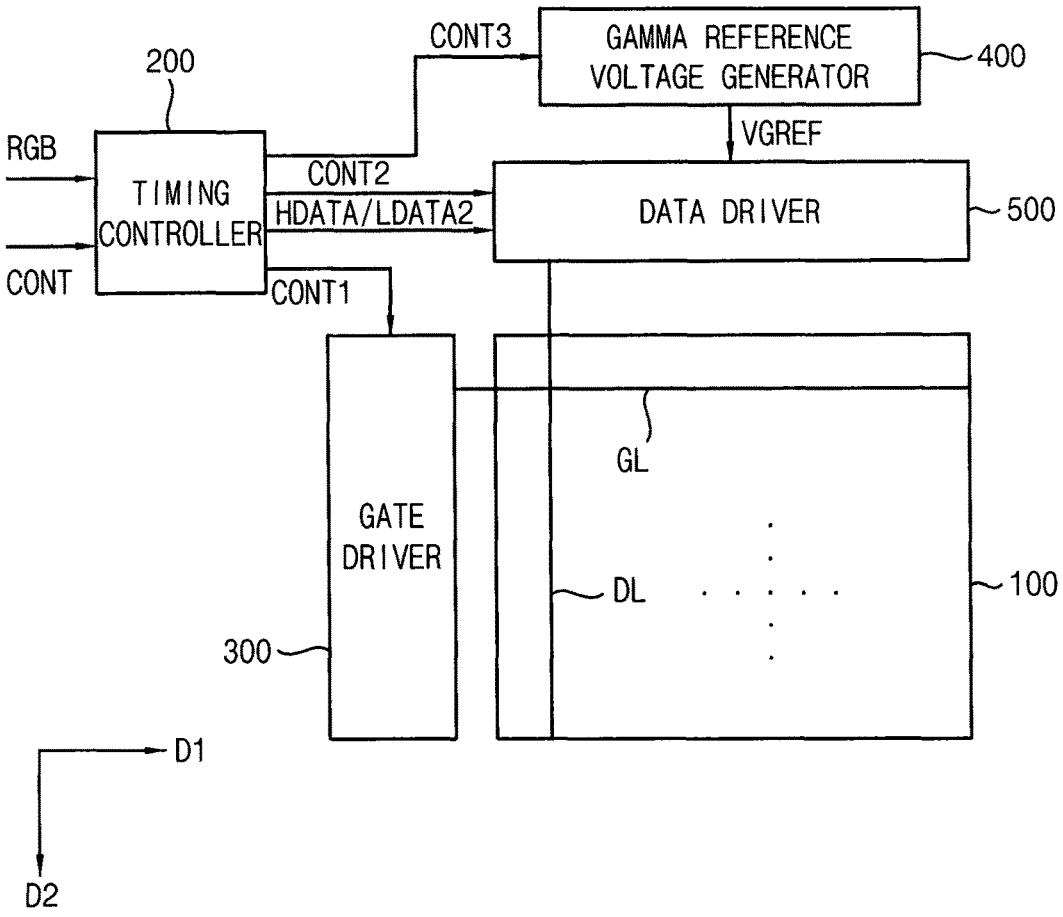
FIG. 1 is a block diagram illustrating a display apparatus according to an exemplary embodiment of the present invention.

FIG. 1 is a block diagram illustrating a display apparatus according to an exemplary embodiment of the present invention. Referring to FIG. 1, the display apparatus includes a display panel 100 and a panel driver. The panel driver includes a timing controller 200, a gate driver 300, a gamma reference voltage generator 400 and a data driver 500.

The display panel 100 has a display region on which an image is displayed and a peripheral region adjacent to the display region. The display panel 100 includes a plurality of gate lines GL, a plurality of data lines DL and a plurality of pixels connected to the gate lines GL and the data lines DL. The gate lines GL extend in a first direction D1 and the data lines DL extend in a second direction D2 crossing the first direction D1.

Each pixel includes a switching element (not shown), a liquid crystal capacitor (not shown) and a storage capacitor (not shown). The liquid crystal capacitor and the storage capacitor are electrically connected to the switching element. The pixels may be disposed in a matrix (two-dimensional array) form.

The timing controller 200 receives input image data RGB and an input control signal CONT from an external apparatus (not shown). The input image data may include red image data R, green image data G and blue image data B. The input control signal CONT may include a master clock signal and a data enabling signal. The input control signal CONT may further include a vertical synchronizing signal and a horizontal synchronizing signal.

The timing controller 200 generates a first control signal CONT1, a second control signal CONT2, a third control signal CONT3 and a data signal HDATA/LDATA2 based on the input image data RGB and the input control signal CONT. The timing controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal. The timing controller 200 generates the data signal HDATA/LDATA2 based on the input image data RGB. The timing controller 200 outputs the data signal HDATA/LDATA2 to the data driver 500.

The timing controller 200 may determine whether the input image data RGB represents a video image or a static image. For example, the timing controller 200 may compare a plurality of frame data of the input image data RGB to determine whether the input image data RGB represents a video image or a static image. When the frame data of the input image data RGB maintain for a threshold number of frames, the input image data RGB may be determined as the static image. When the frame data of the input image data RGB changes in the threshold number of frames, the input image RGB may be determined as the video image. For example, the threshold number of frames may be equal to or greater than three frames. The timing controller 200 may determine whether an image transition occurs in the input image data RGB.

The timing controller 200 may adjust a driving frequency of the display panel 100 according to whether the input image data RGB represents a video image or a static image. The timing controller 200 may insert an image sticking compensation frame, when the input image data RGB represents a static image and an image transition occurs in the input image data RGB. Herein, the image transition means a static image is changed to another static image.

The timing controller 200 generates the third control signal CONT3 for controlling an operation of the gamma reference voltage generator 400 based on the input control signal CONT, and outputs the third control signal CONT3 to the gamma reference voltage generator 400.

A structure and an operation of the timing controller 200 are explained referring to FIGS. 2 to 6 in detail.

The gate driver 300 generates gate signals driving the gate lines GL in response to the first control signal CONT1 received from the timing controller 200. The gate driver 300 sequentially outputs the gate signals to the gate lines GL. The gate driver 300 may be directly mounted on the display panel 100, or may be connected to the display panel 100 as a tape carrier package (TCP) type. Alternatively, the gate driver 300 may be integrated on the display panel 100.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal HDATA/LDATA2. In an exemplary embodiment, the gamma reference voltage generator 400 may be disposed in the timing controller 200, or in the data driver 500.

The data driver 500 receives the second control signal CONT2 and the data signal HDATA/LDATA2 from the timing controller 200, and receives the gamma reference voltages VGREF from the gamma reference voltage generator 400. The data driver 500 converts the data signal HDATA/LDATA2 into data voltages having an analog type using the gamma reference voltages VGREF. The data driver 500 outputs the data voltages to the data lines DL. The data driver 500 may be directly mounted on the display panel 100, or be connected to the display panel 100 in a TCP type. Alternatively, the data driver 500 may be integrated on the display panel 100.

Figure 2:
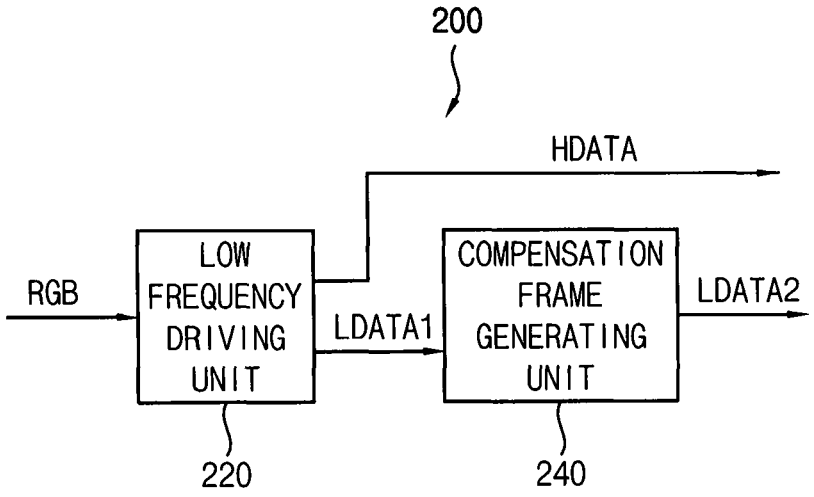
FIG. 2 is a block diagram illustrating a timing controller of FIG. 1.
Figure 3:
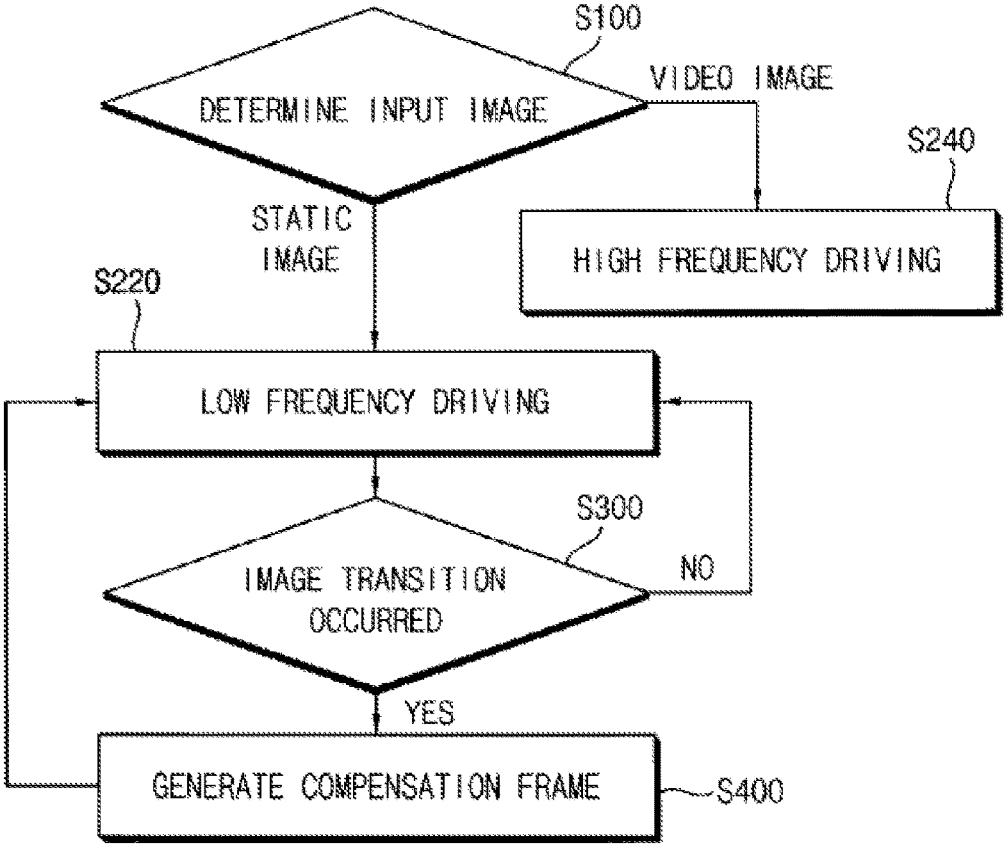
FIG. 3 is a flowchart diagram illustrating an operation of the timing controller of FIG. 2.
Figure 4:
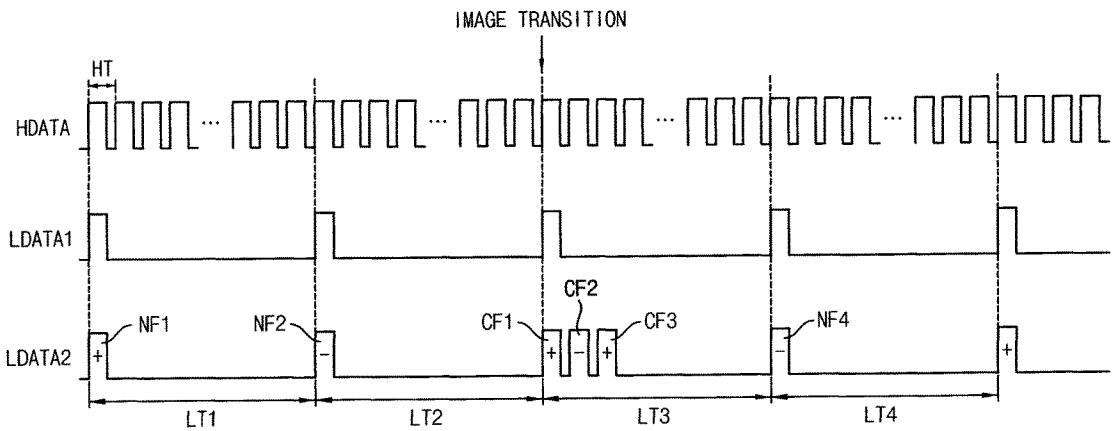
FIG. 4 is a timing diagram illustrating output signals of the timing controller of FIG. 2.

FIG. 2 is a block diagram illustrating the timing controller 200 of FIG. 1. FIG. 3 is a flowchart diagram illustrating an operation of the timing controller 200 of FIG. 2. FIG. 4 is a timing diagram illustrating output signals of the timing controller 200 of FIG. 2.

Referring to FIGS. 1 to 4, the timing controller 200 includes a low frequency driving unit 220 and a compensation frame generating unit 240.

The low frequency driving unit 220 determines whether the input image data RGB represents a video image or a static image (step S100).

When the input image data RGB represents a video image, the low frequency driving unit 220 generates a first data signal HDATA having a relatively high frequency and outputs the first data signal HDATA to the data driver 500 (step S240). For example, the relatively high frequency may be about 60 Hz. Alternatively, the relatively high frequency may be about 120 Hz. Alternatively, the relatively high frequency may be about 240 Hz.

When the input image data RGB represents a static image, the low frequency driving unit 220 generates a second data signal LDATA1 having a relatively low frequency and outputs the second data signal LDATA1 to the compensation frame generating unit 240 (step S220). For example, the relatively low frequency may be about 1 Hz. Alternatively, the relatively low frequency may be about 10 Hz. Alternatively, the relatively low frequency may be about 30 Hz. For example, when the input image data RGB represents a static image, the low frequency driving unit 220 may determine a flicker generating degree of the static image. The flicker may be generated due to the difference of luminances in a positive frame and a negative frame. In addition, the flicker is serious in a middle band of grayscale levels (e.g. 50 grayscales to 200 grayscales). When the static image has many grayscales in the middle band of grayscale levels, the flicker generating degree may increase. When the static image has little grayscales in the middle band of grayscale levels, the flicker generating degree may decrease.

When the input image data RGB is not a text static image including a text and the flicker generating degree of the static image is relatively high, the second data signal LDATA1 has a first low frequency less than a normal driving frequency (e.g. the relatively high frequency of the first data signal HDATA). For example, the first low frequency may be about 30 Hz. When the input image data RGB is not a text static image including a text and the flicker generating degree of the static image is relatively low, the second data signal LDATA1 has a second low frequency less than the first low frequency. For example, the second low frequency may be about 10 Hz.

When the input image data RGB is the text static image including a text, the flicker generating degree of the text static image is very low. The text generally occupies a small area so that the flicker in the text is not easily shown to a user. When the input image data RGB is the text static image, the second data signal LDATA1 has a third low frequency less than the second low frequency. For example, the third low frequency may be about 1 Hz.

When the input image data RGB represent a static image, the compensation frame generating unit 240 determines whether an image transition occurs in the input image data RGB (step S300).

When the input image data RGB represent a static image and an image transition occurs in the input image data RGB, the compensation frame generating unit 240 inserts a plurality of image sticking compensation frames between normal frames of the second data signal LDATA1 in a cycle of low frequency driving to generate a third data signal LDATA2 (step S400).

When the input image data RGB represent a static image and an image transition does not occur in the input image data RGB, the compensation frame generating unit 240 generates the third data signal LDATA2 using the second data signal LDATA1 without inserting the image sticking compensation frames. In other words, in this case, the third data signal LDATA2 is the same as the second data signal LDATA1.

The compensation frame generating unit 240 outputs the third data signal LDATA2 to the data driver 500.

As shown in FIG. 4, when the input image data RGB represents a video image, the display panel 100 is driven using the first data signal HDATA having the relatively high frequency. The display panel 100 is scanned once in a cycle HT of high frequency driving by the first data signal HDATA. When the display panel 100 is driven in the relatively high frequency, image of the display panel 100 is refreshed in the short cycle (time period) HT so that an image sticking due to the image transition may not be generated. If the relatively high frequency is about 60 Hz, the cycle HT of the high frequency driving is 1/60 second. For example, if it is assumed that the instantaneous image sticking due to the image transition is resolved in three refreshes, then the instantaneous image sticking is disappeared in 1/20 second so that the image sticking may not be shown to an observer.

When the input image data RGB represents a static image, the low frequency driving unit 220 generates the second low data signal LDATA1 having a relatively low frequency. The second low data signal LDATA1 is scanned once in a cycle (e.g. LT1, LT2, LT3, LT4) of low frequency driving by the second data signal LDATA1.

When the image transition does not occur in the input image data RGB, the compensation frame generating unit 240 generates the third data LDATA2 using the second data signal LDATA1 without change (as shown in a first cycle LT1 of the low frequency driving and a second cycle LT2 of the low frequency driving). When the image transition occurs in the input image data RGB, the compensation frame generating unit 240 inserts a plurality of image sticking compensation frames CF1, CF2 and CF3 between normal frames NF2 and NF4 in a cycle of low frequency driving to generate the third data signal LDATA2 (as shown in a third cycle LT3 of the low frequency driving). The image sticking compensation frame may be inserted in the third cycle LT3 of the low frequency driving right after the image transition as shown in FIG. 4. Alternately, the image sticking compensation frame may be inserted in one of the cycle (LT3, LT4 or later) of the low frequency driving after the image transition. The compensation frame generating unit 240 may generate and insert the image sticking compensation frame between after the compensation frame generating unit 240 detects the image transition between a normal frame of a first static image before the image transition and a normal frame of a second static image after the image transition.

When the relatively low frequency is about 1 Hz, the cycle (e.g. LT1, LT2, LT3 and LT4) of the low frequency driving is one second. For example, if the image sticking compensation frames are not inserted despite of the image transition, the image sticking may last for one second during which a first scanning processes. In addition, the image sticking may not disappear for one to two seconds during which a second scanning is performed. If it is assumed that the image sticking disappears in third scanning process, the image sticking may be shown to the observer in two or more seconds so that a display quality of the display panel 100 may be decreased.

In the present exemplary embodiment, three image sticking compensation frames CF1, CF2 and CF3 are inserted in the third cycle of the low frequency driving. A cycle of each of the image sticking compensation frames CF1, CF2 and CF3 is substantially the same as the cycle HT of the high frequency driving of the first data signal HDATA. For example, if the image sticking disappears in third scanning process, the image sticking may be shown in time equal to or less than 1/20 second in the third cycle LT3 of the low frequency driving. Thus, the image sticking may not be recognized to the observer. Thus, when the image sticking compensation frames CF1, CF2 and CF3 having the relatively high frequency are inserted between the normal frames NF2 and NF4 in the image transition, the image sticking may be prevented so that the display quality of the display panel 100 may be improved. In other words, the third cycle LT3 includes the image sticking compensation frames CF1, CF2 and CF3 instead of a normal frame, if an image transition occurs at the third cycle LT3.

In the present exemplar embodiment, the display panel 100 may be driven in an inverting driving method and a polarity of the pixel may be inverted in every frame. For example, a first pixel of the display panel 100 may have a positive polarity (+) during a first normal frame in the first cycle LT1 of the low frequency driving and the first pixel of the display panel 100 may have a negative polarity (−) during a second normal frame in the second cycle LT2 of the low frequency driving. For example, the display panel 100 may be driven in a column inversion method or in a dot inversion method in every frame.

The number of the image sticking compensation frames which inserted in the single cycle of the low frequency driving may be an odd number equal to or greater than three. When the number of the image sticking compensation frames which inserted in the single cycle of the low frequency driving is an odd number, a polarity of the cycle of the low frequency driving may follow the polarity of the first image sticking compensation frame.

For example, a first pixel has a negative polarity (−) and may maintain the negative polarity (−) during the second normal frame NF2 in the second cycle LT2 of the low frequency driving. The first pixel has polarities of (+), (−) and (+) during the first to third image sticking compensation frames CF1, CF2 and CF3 in the third cycle LT3 of the low frequency driving so that the first pixel may maintain the positive polarity during the third cycle LT3 of the low frequency driving. The first pixel has a negative polarity (−) and may maintain the negative polarity (−) during the fourth normal frame NF4 in a fourth cycle LT4 of the low frequency driving.

The odd numbered image sticking compensation frames (e.g. three) are inserted during the third cycle LT3 of the low frequency driving so that the third cycle LT3 of the low frequency driving has a net polarity opposite to the polarity of the second cycle LT2 of the low frequency driving and the fourth cycle LT4 of the low frequency driving. Thus, a residual direct current (DC) component is prevented from being accumulated at the pixel due to unbalance of the polarity. Therefore, an image sticking due to the residual DC component may also be prevented.

In contrast, if two image sticking compensation frames having polarities of (+) and (−) are inserted during the third cycle LT3 of the low frequency driving, the third cycle LT3 of the low frequency driving has the polarity the same as the polarity of the second cycle LT2 of the low frequency driving. Thus, the polarity may be oriented to the negative polarity (−) so that the residual DC component may be accumulated.

Although not shown in figures, the timing controller 200 may further include an image compensating part. The image compensating unit may compensate grayscale data of the input image data RGB and may rearrange the input image data RGB to correspond to a data type of the data driver 500. For example, the image compensating unit may be disposed in front of the low frequency driving unit 220 to transmit the compensated input image data to the low frequency driving unit 220. Alternatively, the image compensating unit may be disposed after the low frequency driving unit 220 and the compensation frame generating unit 240. The image compensating unit may receive the data signal HDATA and LDATA2 from the low frequency driving unit 220 and the compensation frame generating unit 240 and output the compensated data signal HDATA and LDATA2 to the data driver 500.

For example, the image compensating unit may include an adaptive color correcting unit (not shown) and a dynamic capacitance compensating unit (not shown). The adaptive color correcting unit receives the grayscale data of the input image data RGB, and operates an adaptive color correction ("ACC"). The adaptive color correcting unit may compensate the grayscale data using a gamma curve. The dynamic capacitance compensating unit operates a dynamic capacitance compensation ("DCC"), which compensates the grayscale data of present frame data using previous frame data and the present frame data.

Although not shown in figures, the timing controller 200 may further include a signal generating part. The signal generating unit receives the input control signal CONT. The signal generating unit generates the first control signal CONT1 to control a driving timing of the gate driver 300 based on the input control signal CONT and the driving frequency. The signal generating unit generates the second control signal CONT2 to control a driving timing of the data driver 500 based on the input control signal CONT and the driving frequency. The signal generating unit generates the third control signal CONT3 to control a driving timing of the gamma reference voltage generator 400 based on the input control signal CONT and the driving frequency. The signal generating unit outputs the first control signal CONT1 to the gate driver 300. The signal generating unit outputs the second control signal CONT2 to the data driver 500. The signal generating unit outputs the third control signal CONT3 to the gamma reference voltage generator 400.

Figure 5:
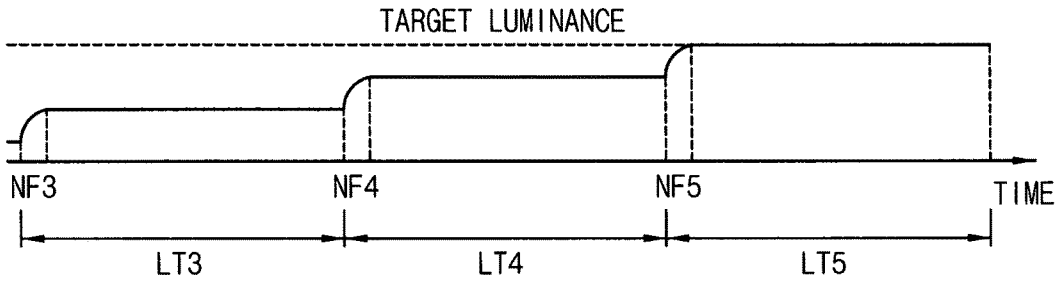
FIG. 5 is a timing diagram illustrating luminance of pixel when an image sticking compensation frame is not inserted by the timing controller of FIG. 2.
Figure 6:
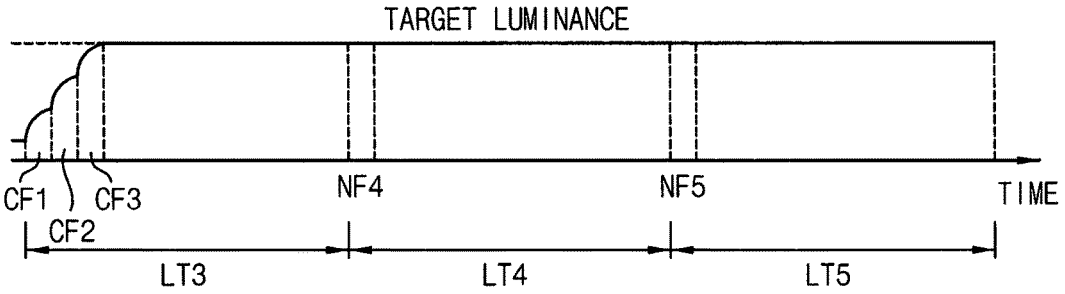
FIG. 6 is a timing diagram illustrating luminance of pixel when an image sticking compensation frame is inserted by the timing controller of FIG. 2.

FIG. 5 is a timing diagram illustrating luminance of pixel when an image sticking compensation frame is not inserted by the timing controller 200 of FIG. 2. FIG. 6 is a timing diagram illustrating luminance of pixel when an image sticking compensation frame is inserted by the timing controller 200 of FIG. 2.

Referring to FIG. 5, an image transition occurs right before the third cycle LT3 of the low frequency driving, and a normal frame NF3 is included in the third cycle LT3 of the low frequency driving.

During a third normal frame NF3, a grayscale less than a target grayscale is charged at a pixel so that the display panel 100 represents luminance less than a target luminance during the third cycle LT3 of the low frequency driving. During a fourth normal frame NF4, a pixel voltage is further charged. However, the grayscale charged at the pixel is less than the target grayscale so that the display panel 100 represents luminance less than the target luminance during the fourth cycle LT4 of the low frequency driving. During a fifth normal frame NF5, the target grayscale is finally charged at the pixel so that the display panel 100 represents the target luminance from the fifth cycle LT5 of the low frequency driving.

If the cycle of the low frequency driving is a second, the display panel 100 represents luminance less than the target luminance for two or more seconds so that the image sticking may be shown to an observer.

Referring to FIG. 6, an image transition occurs right before the third cycle LT3 of the low frequency driving, and three image sticking compensation frames CF1, CF2 and CF3 are included in the third cycle LT3 of the low frequency driving.

During a first image sticking compensation frame CF1, a grayscale less than a target grayscale is charged at a pixel so that the display panel 100 instantaneously represents luminance less than a target luminance. During a second image sticking compensation frame CF2, a pixel voltage is further charged. The luminance of the image on the display panel 100 gets closer to the target luminance. During a third image sticking compensation frame CF3, the target grayscale is finally charged at the pixel so that the display panel 100 represents the target luminance during remaining third cycle LT3 of the low frequency driving.

If the duration of each the image sticking compensation frame (the cycle of each of image sticking compensation frame CF1, CF2 and CF3) is 1/60 second, the display panel 100 represents luminance less than the target luminance for 1/20 second or less so that the image sticking may not be shown to an observer.

In the present exemplary embodiment, the data signal of the image sticking compensation frame may be substantially the same as the data signal of the normal frame for the same input image. For example, the data signal of the image sticking compensation frame may be substantially the same as the target data signal to display the target luminance.

According to the present exemplary embodiment, when the input image data represents a static image and a image transition occurs, the image sticking compensation frames are inserted between the normal frames so that the instantaneous image sticking due to the image transition may be prevented. The number of the image sticking compensation frames is properly adjusted so that the permanent image sticking due to the residual DC component may be prevented. Therefore, the power consumption of the display apparatus may be reduced and the display quality of the display panel 100 may be improved.

Figure 7:
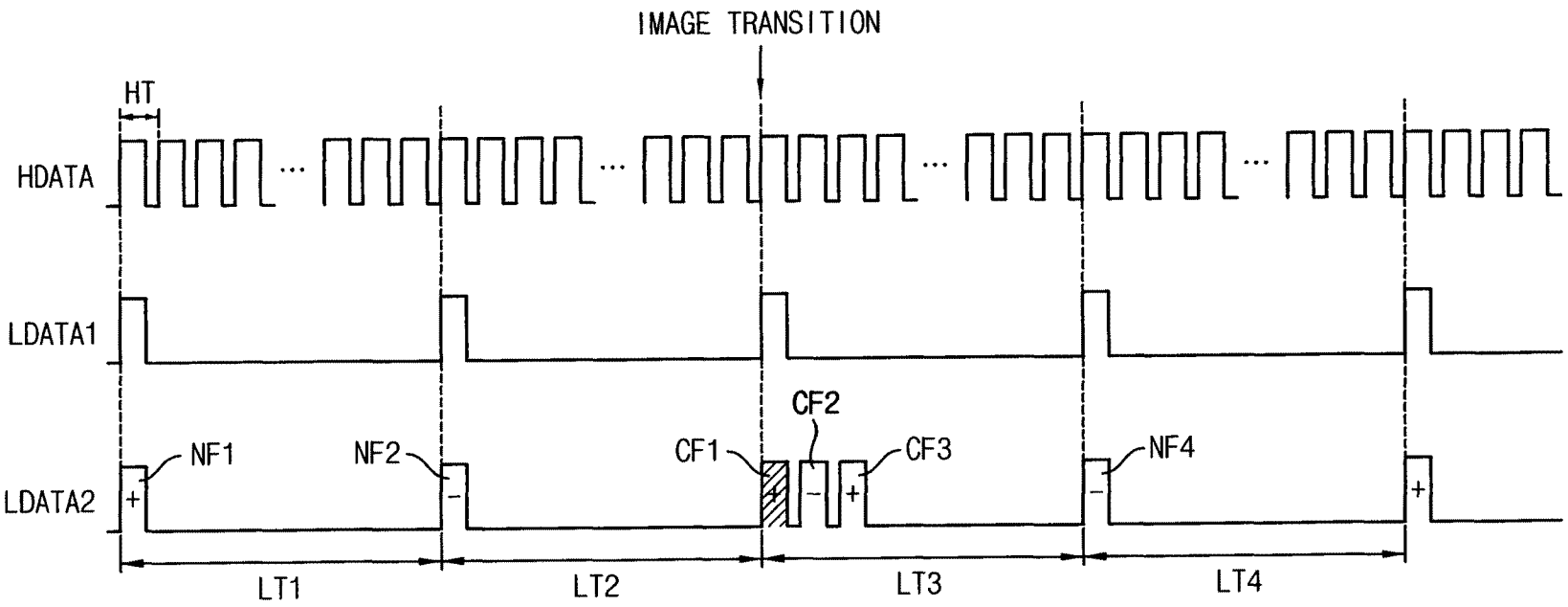
FIG. 7 is a timing diagram illustrating output signals of the timing controller of a display apparatus according to an exemplary embodiment of the present invention.
Figure 8:
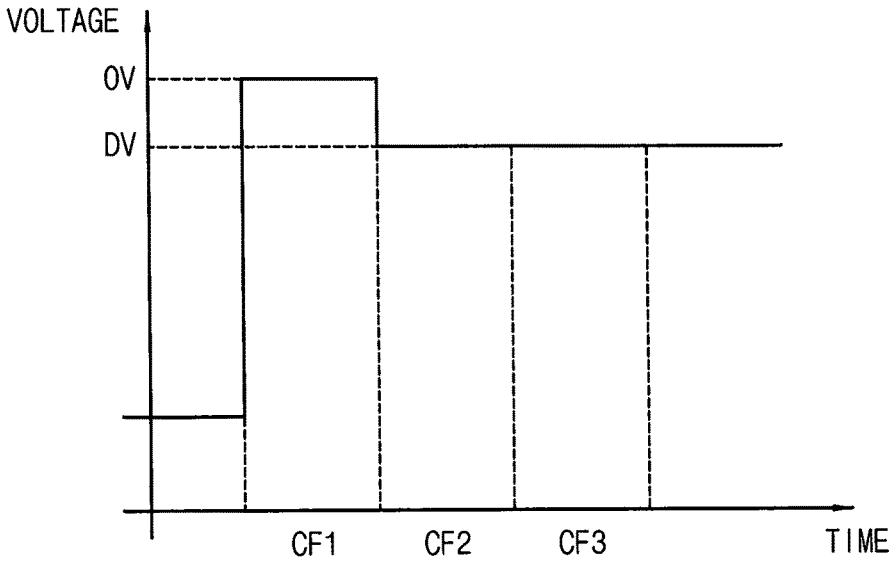
FIG. 8 is a timing diagram illustrating a level of a data signal of an image sticking compensation frame generated by the timing controller of FIG. 7.
Figure 9:
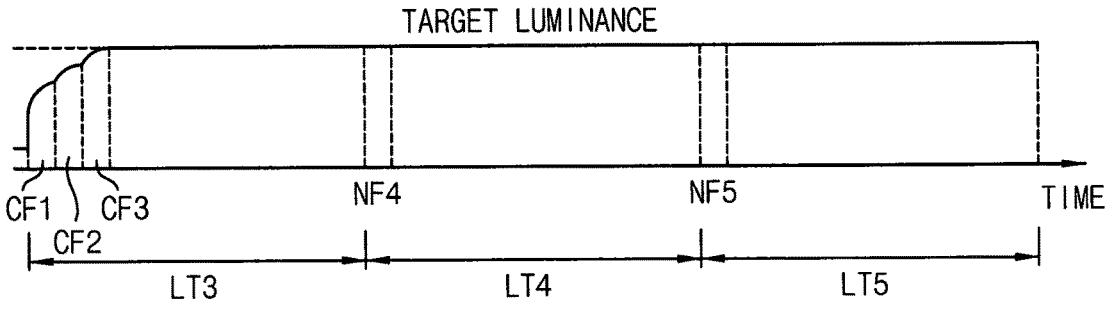
FIG. 9 is a timing diagram illustrating luminance of pixel when an image sticking compensation frame is inserted by the timing controller of FIG. 7.

FIG. 7 is a timing diagram illustrating output signals of the timing controller of a display apparatus according to an exemplary embodiment of the present invention. FIG. 8 is a timing diagram illustrating a level of a data signal of an image sticking compensation frame generated by the timing controller of FIG. 7. FIG. 9 is a timing diagram illustrating luminance of pixel when an image sticking compensation frame is inserted by the timing controller of FIG. 7.

The method of driving the display panel and the display apparatus according to the present exemplary embodiment is substantially the same as the method of driving the display panel and the display apparatus of the previous exemplary embodiment explained referring to FIGS. 1 to 6 except that the pixel is driven by an overshooting method in the first image sticking compensation frame. Thus, the same reference numerals will be used to refer to the same or like parts as those described in the previous exemplary embodiment of FIGS. 1 to 6 and any repetitive explanation concerning the above elements will be omitted.

Referring to FIGS. 1 to 3 and 7 to 9, the display apparatus includes a display panel 100 and a panel driver. The panel driver includes a timing controller 200, a gate driver 300, a gamma reference voltage generator 400 and a data driver 500.

The timing controller 200 may adjust a driving frequency of the display panel 100 according to whether the input image data RGB represents a video image or a static image. The timing controller 200 may insert an image sticking compensation frame, when the input image data RGB represents a static image and an image transition occurs in the input image data RGB.

The timing controller 200 includes a low frequency driving unit 220 and a compensation frame generating unit 240. The low frequency driving unit 220 determines whether the input image data RGB represents a video image or a static image (step S100). When the input image data RGB represents a video image, the low frequency driving unit 220 generates a first data signal HDATA having a relatively high frequency and outputs the first data signal HDATA to the data driver 500 (step S240).

When the input image data RGB represents a static image, the low frequency driving unit 220 generates a second data signal LDATA1 having a relatively low frequency and outputs the second data signal LDATA1 to the compensation frame generating unit 240 (step S220). When the input image data RGB represents a static image, the compensation frame generating unit 240 determines whether an image transition occurs in the input image data RGB (step S300). When the input image data RGB represents a static image and an image transition occurs in the input image data RGB, the compensation frame generating unit 240 inserts a plurality of image sticking compensation frames between normal frames of the second data signal LDATA1 in a cycle of low frequency driving to generate a third data signal LDATA2 (step S400).

In the present exemplary embodiment, three image sticking compensation frames CF1, CF2 and CF3 are inserted in the third cycle LT3 of the low frequency driving. A cycle of the image sticking compensation frames CF1, CF2 and CF3 is substantially the same as the cycle HT of the high frequency driving of the first data signal HDATA. For example, if the image sticking disappears in third scanning process, the image sticking may be shown in time equal to or less than 1/20 second in the third cycle LT3 of the cycle LT3 of the low frequency driving. Thus, the image sticking may not be recognized to the observer. Thus, when the image sticking compensation frames CF1, CF2 and CF3 having the relatively high frequency are inserted between the normal frames NF2 and NF4 in the image transition, the image sticking may be prevented so that the display quality of the display panel 100 may be improved.

Referring to FIGS. 8 and 9, an image transition occurs right before the third cycle LT3 of the low frequency driving, and three image sticking compensation frames CF1, CF2 and CF3 are included in the third cycle LT3 of the low frequency driving.

In the present exemplary embodiment, the data signal of the first image sticking compensation frame CF1 may be greater than the data signal of the second and third image sticking compensation frames CF2 and CF3. For example, the first image sticking compensation frame CF1 has an overshoot data signal OV. The second and third image sticking compensation frames CF2 and CF3 have normal data signals DV. The normal data signal DV is a target data signal corresponding to the target luminance of the display panel 100 during the third cycle LT3 of the low frequency driving. The overshoot data signal OV is an overshoot signal which is greater than the target data signal. In other words, as shown in FIG. 8, the voltage level (overshoot data signal OV) of the first image sticking compensation frame CF1 is greater than the voltage level (normal data signal DV) of the second and third image sticking compensation frames CF2 and CF3. The image sticking compensation frames CF2 and CF3, to which the overshooting driving is not applied, includes the data signal substantially the same as the target data signal.

The overshoot data signal OV may be generated by comparing the present frame data and the previous frame data. As the difference between the present frame data and the previous frame data increases, the difference between the overshoot data signal OV and the target data signal may increase. When the present frame data is substantially the same as the previous frame data, the overshoot data signal OV may be substantially the same as the target data signal.

Although, the first image sticking compensation frame CF1 is overshot among the first to third image sticking compensation frames CF1, CF2 and CF3 in the present exemplary embodiment, the present invention is not limited thereto. At least one image sticking compensation frame including the first image sticking compensation frame may be overshot. For example, the first and second image sticking compensation frames CF1 and CF2 may be overshot. For example, the first to third image sticking compensation frames CF1, CF2 and CF3 may be overshot.

During the first image sticking compensation frame CF1, the overshoot data signal OV is applied to the pixel. The grayscale slightly less than the target grayscale is charged at the pixel during the first image sticking compensation frame CF1 so that the display panel 100 instantaneously represents luminance less than a target luminance. By the overshoot driving method, the luminance of the image on the display panel 100, shown in FIG. 9, is higher than the luminance of the image on the display panel 100 in FIG. 6 during the first image sticking compensation frame CF1.

During a second image sticking compensation frame CF2, a pixel voltage is further charged. The luminance of the image on the display panel 100 gets closer to the target luminance. During a third image sticking compensation frame CF3, the target grayscale is finally charged at the pixel so that the display panel 100 represents the target luminance during remaining third cycle LT3 of the low frequency driving.

If the duration of each the image sticking compensation frame is 1/60 second, the display panel 100 represents luminance less than the target luminance for 1/20 second or less so that the image sticking may not be shown to an observer.

According to the present exemplary embodiment, when the input image data represents the static image and the image transition occurs, the image sticking compensation frames are inserted between the normal frames so that the instantaneous image sticking due to the image transition may be prevented. The number of the image sticking compensation frames is properly adjusted so that the permanent image sticking due to the residual DC component may be prevented. Therefore, the power consumption of the display apparatus may be reduced and the display quality of the display panel 100 may be improved.

Figure 10:
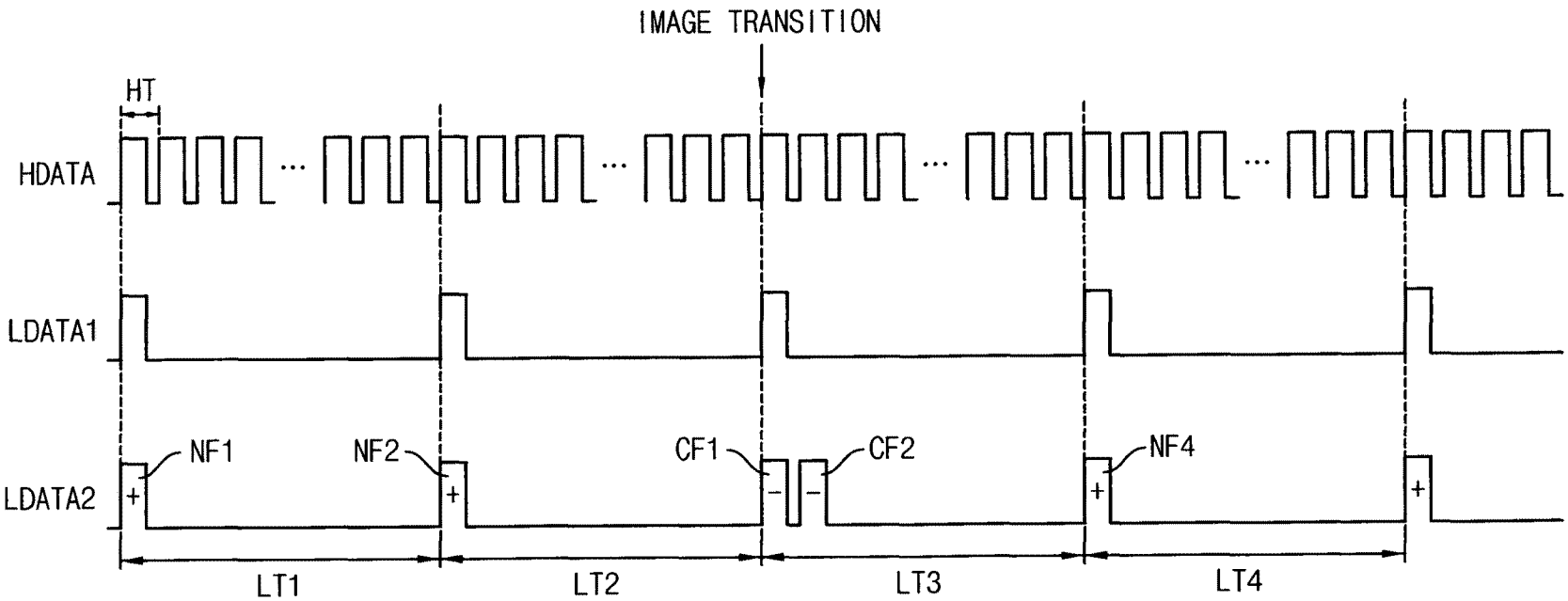
FIG. 10 is a timing diagram illustrating output signals of the timing controller of a display apparatus according to an exemplary embodiment of the present invention.

FIG. 10 is a timing diagram illustrating output signals of the timing controller of a display apparatus according to an exemplary embodiment of the present invention.

The method of driving the display panel and the display apparatus according to the present exemplary embodiment shown in FIG. 10 is substantially the same as the method of driving the display panel and the display apparatus of the previous exemplary embodiment explained referring to FIGS. 1 to 6 except for the inversion driving method and the number of the image sticking compensation frames. Thus, the same reference numerals will be used to refer to the same or like parts as those described in the previous exemplary embodiment of FIGS. 1 to 6 and any repetitive explanation concerning the above elements will be omitted.

Referring to FIGS. 1 to 3 and 10, the display apparatus includes a display panel 100 and a panel driver. The panel driver includes a timing controller 200, a gate driver 300, a gamma reference voltage generator 400 and a data driver 500.

The timing controller 200 may adjust a driving frequency of the display panel 100 according to whether the input image data RGB represents a video image or a static image. The timing controller 200 may insert an image sticking compensation frame, when the input image data RGB represents a static image and an image transition occurs in the input image data RGB.

The timing controller 200 includes a low frequency driving unit 220 and a compensation frame generating unit 240. The low frequency driving unit 220 determines whether the input image data RGB represents a video image or a static image (step S100). When the input image data RGB represents a video image, the low frequency driving unit 220 generates a first data signal HDATA having a relatively high frequency and outputs the first data signal HDATA to the data driver 500 (step S240).

When the input image data RGB represents a static image, the low frequency driving unit 220 generates a second data signal LDATA1 having a relatively low frequency and outputs the second data signal LDATA1 to the compensation frame generating unit 240 (step S220). When the input image data RGB represent a static image, the compensation frame generating unit 240 determines whether an image transition occurs in the input image data RGB (step S300).

When the input image data RGB represent a static image and an image transition occurs in the input image data RGB, the compensation frame generating unit 240 inserts a plurality of image sticking compensation frames between normal frames of the second data signal LDATA1 in a cycle of low frequency driving to generate a third data signal LDATA2 (step S400).

In the present exemplary embodiment, three image sticking compensation frames CF1 and CF2 are inserted in the third cycle LT3 of the low frequency driving. A cycle of the image sticking compensation frames CF1 and CF2 is substantially the same as the cycle HT of the high frequency driving of the first data signal HDATA. For example, if the image sticking disappears in second scanning process, the image sticking may be shown in time equal to or less than 1/30 second in the third cycle LT3 of the cycle LT3 of the low frequency driving. Thus, the image sticking may not be recognized to the observer.

Thus, when the image sticking compensation frames CF1 and CF2 having the relatively high frequency are inserted between the normal frames NF2 and NF4 in the image transition, the image sticking may be prevented so that the display quality of the display panel 100 may be improved.

In the present exemplar embodiment, the display panel 100 may be driven in an inverting driving method and a polarity of the pixel may be inverted in every two frames. For example, a first pixel of the display panel 100 may have a positive polarity (+) during a first normal frame in the first cycle LT1 of the low frequency driving, and the first pixel of the display panel 100 may have a positive polarity (+) during a second normal frame in the second cycle LT2 of the low frequency driving. For example, the display panel 100 may be driven in a column inversion method or in a dot inversion method in every two frames.

The number of the image sticking compensation frames inserted in the single cycle of the low frequency driving, may be 4N−2. Herein, N is a positive integer. For example, the number of the image sticking compensation frames which inserted in the single cycle of the low frequency driving may be 2, 6, 10 and so on. When the number of the image sticking compensation frames inserted in the single cycle of the low frequency driving is 4N−2, the cycle of the low frequency driving may maintain a polarity opposite to the polarity of the previous cycle of the low frequency driving.

For example, a first pixel has a positive polarity (+) and may maintain the positive polarity (+) during the second normal frame NF2 in the second cycle LT2 of the low frequency driving. The first pixel has a negative polarity (−) during the first and second image sticking compensation frames CF1 and CF2 in the third cycle LT3 of the low frequency driving so that the first pixel may maintain the negative polarity (−) during the third cycle LT3 of the low frequency driving.

The 4N−2 image sticking compensation frames (e.g. two) are inserted during the third cycle LT3 of the low frequency driving so that the third cycle LT3 of the low frequency driving has a polarity opposite to the polarity of the second cycle LT2 of the low frequency driving which is the previous cycle. Thus, a residual DC component is prevented from being accumulated at the pixel due to unbalance of the polarity. Therefore, an image sticking due to the residual DC component may also be prevented.

In contrast, if two image sticking compensation frames having polarities of (−), (−) and (+) are inserted during the third cycle LT3 of the low frequency driving, the third cycle LT3 of the low frequency driving has the polarity same as the polarity of the second cycle LT2 of the low frequency driving. Thus, the polarity may be oriented to the negative polarity (−) so that the residual DC component may be accumulated.

According to the present exemplary embodiment, the input image data represents the static image and the image transition occurs, the image sticking compensation frames are inserted between the normal frames so that the instantaneous image sticking due to the image transition may be prevented. The number of the image sticking compensation frames is properly adjusted so that the permanent image sticking due to the residual DC component may be prevented. Therefore, the power consumption of the display apparatus may be reduced and the display quality of the display panel 100 may be improved.

According to the present exemplary embodiment, a power consumption of the display apparatus may be reduced and a display quality of the display panel may be improved.

The foregoing is illustrative of the present invention and is not to be construed as limiting thereof. Although a few exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present invention is defined by the following claims, with equivalents of the claims to be included therein.

What is claimed is:

1. A method of driving a display panel, the method comprising:

determining whether an input image data represents a video image or a static image, the input image data being determined as representing the video image if a frame data of the input image data changing in a threshold number of frames, otherwise the input image data being determined as representing the static image;

generating a first data signal having a normal driving frequency if the input image data represents the video image, and generating a second data signal having a low frequency if the input image data represents the static image, the low frequency being smaller than the normal driving frequency;

determining whether an image transition occurs in the input image data only when the input image data represents the static image, the image transition defined as that a static image is changed to another static image;

generating a third data signal from the second data signal if the image transition occurs only when the input image data represents the static image, the third data signal generated by inserting a plurality of image sticking compensation frames in a cycle of the second data signal at which the image transition occurs; and outputting the first data signal to a data driver if the input image data represents the video image, and outputting the third data signal to the data driver if the input image data represents the static image.

2. The method of claim 1, wherein a polarity of the third data signal is inverted in every frame, and a number of the image sticking compensation frames is an odd number equal to or greater than three.

3. The method of claim 1, wherein a polarity of the third data signal is inverted in every two frames, and a number of the image sticking compensation frames is 4N−2, where N is a positive integer.

4. The method of claim 1, wherein the image sticking compensation frames are inserted between normal frames if the image transition occurs only when the input image data represents the static image, and a data signal of the image sticking compensation frame is substantially the same as a data signal of the normal frame for a same image.

5. The method of claim 1, wherein a voltage of at least one of the image sticking compensation frames is greater than voltages of rest of the image sticking compensation frames.

6. The method of claim 5, wherein the voltages of the rest of the image sticking compensation frames are substantially the same.

7. The method of claim 1, further comprising determining a flicker generating degree of the static image, wherein when the input image data represents the static image and the flicker generating degree of the static image is greater than a predetermined value, the low frequency is a first low frequency;

when the input image data represents the static image and the flicker generating degree of the static image is smaller than the predetermined value, the low frequency is a second low frequency that is smaller than the first low frequency, and when the input image data represents a text static image including a text, the low frequency is a third low frequency that is smaller than the second low frequency.

8. A display apparatus, comprising:

a display panel to display an image;

a timing controller performing operations comprising:

determining whether an input image data represents a video image or a static image, the input image data being determined as representing the video image if a frame data of the input image data changing in a threshold number of frames, otherwise the input image data being determined as representing the static image;

generating a first data signal having a normal driving frequency if the input image data represents the video image, and generating a second data signal having a low frequency if the input image data represents the static image, the low frequency being smaller than the normal driving frequency;

determining whether an image transition occurs in the input image data only when the input image data represents the static image, the image transition defined as that a static image is changed to another static image; and generating a third data signal from the second data signal if the image transition occurs only when the input image data represents the static image, the third data signal generated by inserting a plurality of image sticking compensation frames in a cycle of the second data signal at which the image transition occurs; and a data driver coupled to the timing controller outputting the first data signal to the data driver if the input image data represents the video image, the timing controller outputting the third data signal to the data driver if the input image data represents the static image, the data driver generating a data voltage based on the first or third data signal and outputting the data voltage to the display panel.

9. The display apparatus of claim 8, wherein the timing controller comprises:

a low frequency driving unit to generate the first data signal when the input image data represents the video image, and to generate the second data signal when the input image data represents the static image; and a compensation frame generating unit to insert the image sticking compensation frames into the second data signal to generate the third data signal when the input image data represents the static image and the image transition occurs in the input image data.

10. The display apparatus of claim 9, wherein a polarity of the third data signal is inverted in every frame, and a number of the image sticking compensation frames is an odd number equal to or greater than three.

11. The display apparatus of claim 9, wherein a polarity of the third data signal is inverted in every two frames, and a number of the image sticking compensation frames is 4N−2, where N is a positive integer.

12. The display apparatus of claim 9, wherein the image sticking compensation frames are inserted between normal frames if the image transition occurs only when the input image data represents the static image, and a data signal of the image sticking compensation frame is substantially the same as a data signal of the normal frame for a same image.

13. The display apparatus of claim 9, wherein the compensation frame generating unit overshoots at least one image sticking compensation frame after the image transition, a voltage of said at least one image sticking compensation frame is greater than voltages of rest of the image sticking compensation frames.

14. The display apparatus of claim 13, wherein the voltages of the rest of the image sticking compensation frames are substantially the same.

15. The display apparatus of claim 9, wherein the timing controller further performing an operation of determining a flicker generating degree of the static image, when the input image data represents the static image and the flicker generating degree of the static image is greater than a predetermined value, the low frequency driving unit generates the second data signal having a first low frequency for the low frequency, when the input image data represents the static image and the flicker generating degree of the static image is smaller than the predetermined value, the low frequency driving unit generates the second data signal having a second low frequency for the low frequency, the second low frequency being smaller than the first low frequency, and when the input image data represents a text static image including a text, the low frequency driving unit generates the second data signal having a third low frequency for the low frequency, the third low frequency being smaller than the second low frequency.

* * * * *